US008753043B2

(12) United States Patent
Irvine et al.

(10) Patent No.: US 8,753,043 B2
(45) Date of Patent: Jun. 17, 2014

(54) ACTIVE GRIPPING SHEET PILING INSTALLATION SYSTEM AND METHOD

(75) Inventors: John E. Irvine, Atlanta, GA (US); Steven E. Hargrave, Roswell, GA (US)

(73) Assignee: CMI Limited Company, Atlanta, GA (US)

( * ) Notice: Subject to any disclaimer, the term of this patent is extended or adjusted under 35 U.S.C. 154(b) by 184 days.

(21) Appl. No.: 13/104,207

(22) Filed: May 10, 2011

(65) Prior Publication Data

US 2011/0280670 A1 Nov. 17, 2011

Related U.S. Application Data

(60) Provisional application No. 61/333,379, filed on May 11, 2010.

(51) Int. Cl.
*E02D 5/02* (2006.01)

(52) U.S. Cl.
USPC ..... 405/274; 340/686.6

(58) Field of Classification Search
USPC ..... 405/274, 276, 277, 278, 279, 281; 340/686.6, 686.1, 545.7
See application file for complete search history.

(56) References Cited

U.S. PATENT DOCUMENTS

| | | | | |
|---|---|---|---|---|
| 838,152 | A * | 12/1906 | Williams | 405/281 |
| 4,664,560 | A * | 5/1987 | Cortlever | 405/129.8 |
| 5,503,503 | A | 4/1996 | Glass et al. | |
| 5,803,672 | A | 9/1998 | Glass et al. | |
| 6,231,271 | B1 | 5/2001 | Glass et al. | |
| 7,056,066 | B2 | 6/2006 | Irvine | |
| 7,914,237 | B2 | 3/2011 | Glass et al. | |
| 7,999,691 | B2 * | 8/2011 | Wolf et al. | 340/686.6 |
| 2006/0045631 | A1 * | 3/2006 | Irvine | 405/274 |
| 2010/0290843 | A1 | 11/2010 | Irvine et al. | |

FOREIGN PATENT DOCUMENTS

DE 4442015 A1 * 5/1996

* cited by examiner

*Primary Examiner* — Tara M. Pinnock
*Assistant Examiner* — Kyle Armstrong
(74) *Attorney, Agent, or Firm* — Gardner Groff Greenwald & Villanueva, PC

(57) ABSTRACT

A system and method for installing sheet piles using active gripping along side portions of the sheet piles. A sheet pile profile including first and second locking profiles and a gripping flange enables engagement of the sheet piles onto a mandrel for installation. Double engagement flanges on the locking profiles and an expandable connection between adjacent sheet piles provide improved resistance to fluid passage.

34 Claims, 9 Drawing Sheets

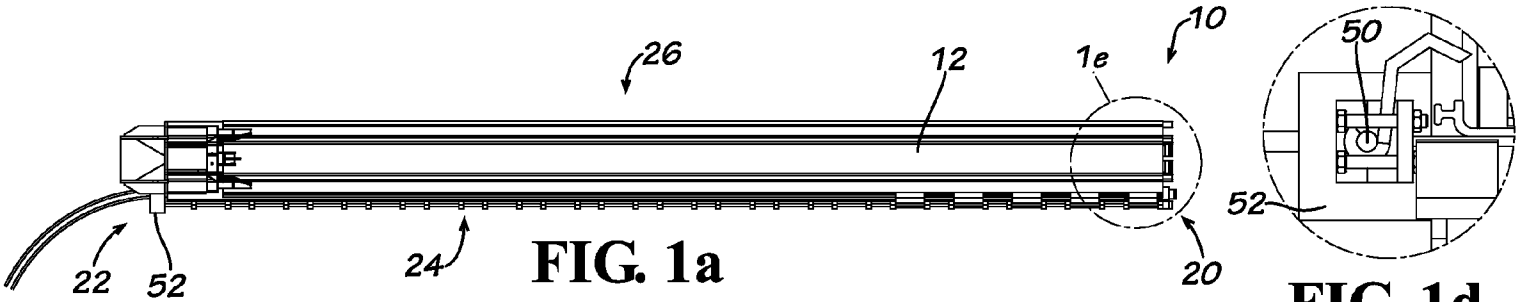
FIG. 1a
FIG. 1d
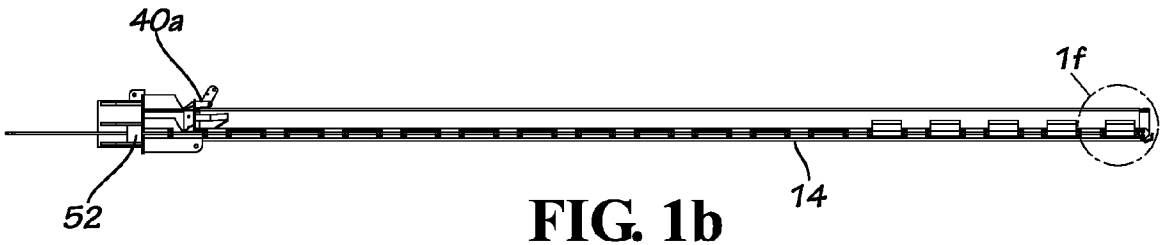
FIG. 1b
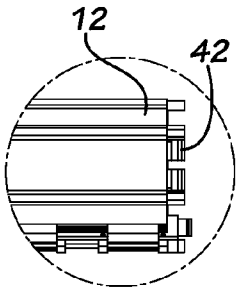
FIG. 1e
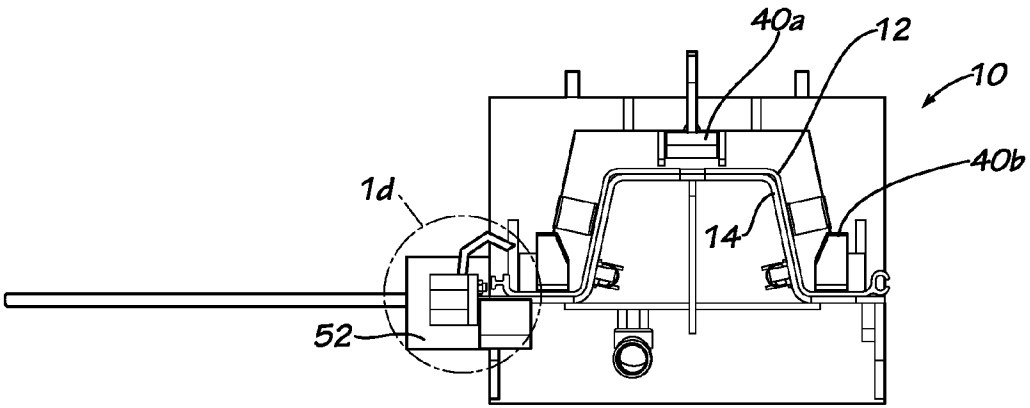
FIG. 1c
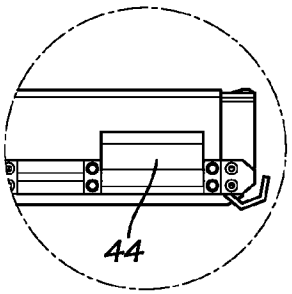
FIG. 1f

ACTIVE GRIPPING SHEET PILING INSTALLATION SYSTEM AND METHOD

CROSS-REFERENCE TO RELATED APPLICATION

This application claims the benefit of U.S. Provisional Patent Application Ser. No. 61/333,379, filed May 11, 2010, the entirety of which is hereby incorporated herein by reference for all purposes.

TECHNICAL FIELD

The present invention relates generally to the field of subsurface barrier walls and/or flood walls, and more particularly to a sheet piling system and an active gripping system and method of installation of a sheet piling system.

BACKGROUND

Barrier walls and flood walls can be formed from a plurality of elongated, vertically-oriented piles driven completely into the earth, or to a depth sufficient to support the piles in an upright orientation above the earth. In some cases, the piles are in the form of extruded structural sheet piles and are formed with male and female opposed edges so that similar sheet piles can be locked together at their adjacent side edges to form a continuous barrier or "cutoff" wall for blocking migration of subsurface fluids and/or surface fluids. Such barrier walls may also be utilized for seawalls, dikes, retaining walls, and other applications.

Sheet piles can be formed of various materials, including without limitation, polyvinyl chloride (PVC), high-density polyethylene (HDPE), or other plastics, fiberglass, composite, aluminum, steel or other metals, ceramics, and/or other materials. The most commonly used sheet piles typically have a Z-shape, Box-shape, or other corrugated cross-sectional profile to provide a measure of structural rigidity. Flat shaped sheet pile profiles are occasionally used in shallow driving depths or low lateral load applications. Regardless of their material and/or profile, however, sheet pilings are subject to buckling deformation during installation and/or from lateral loading. This buckling deformation typically increases exponentially as the length of the pilings increase.

A mandrel system can be utilized for installation of sheet piles when the depth the pile is to be driven and/or the hardness of the soil or other substrate through which the pile is to be driven exceed the structural ability of the piling to resist deformation. U.S. Pat. No. 7,056,066 and U.S. patent application Ser. No. 12/778,545, both incorporated herein by reference, disclose various apparatus and methods for installing sheet piles into a soil formation. Many known mandrel systems and installation methods, however, are limited by the passive attachment of the piling to the mandrel. For example, in deeper installations, the skin friction generated by the soil contacting the sheet piling can be greater than the passive gripping forces applied as the mandrel is driven into the soil. This limitation of the current systems and methods restricts the length of pile that can be installed and/or mandates the use of a much heavier pile than necessary.

Accordingly, it can be seen that needs exist for improved sheet piling systems and improved installation methods and apparatus for sheet piling systems. It is to the provision of systems, methods and apparatus meeting these and other needs that the present invention is primarily directed.

SUMMARY

In example embodiments, the present invention provides improved sheet pile configurations and improved installation methods and apparatus, providing more effective installation and improved efficiencies. Example forms of the invention provide an active gripping mechanism for engagement with an installation mandrel along one or both sides of the sheet pile. Example forms of the invention also provide an improved mandrel configuration to reduce damage to the lower or leading edge of the sheet piles during installation and to resist detachment of the male and female interlocks of adjacent sheet piles. Example forms of the invention also provide a sheet pile having a profile allowing engagement by the mandrel along both sides on the same face of the sheet pile, and allowing expansion between adjacent sheet piles to maintain the interlock integrity.

In one aspect, the present invention relates to a method of installing a sheet pile. The method includes actively gripping a portion of a sheet pile by actuating an active gripping member of an installation mandrel, driving the mandrel with the sheet pile carried thereon into the ground to an installation depth, releasing the active gripping member, and withdrawing the mandrel to leave the sheet pile in place in the ground.

In another aspect, the invention relates to a system for installing a sheet pile, the system including a mandrel having at least one active gripping member for engaging and releasing the sheet pile.

In still another aspect, the invention relates to a method of installing a sheet pile. The method includes providing a sheet pile having first and second sides and first and second ends, mounting the sheet pile onto a mandrel and engaging the sheet pile to the mandrel along at least a portion of the first side, driving one of the first and second ends into the ground, and releasing the sheet pile from the mandrel and withdrawing the mandrel from the ground leaving the sheet pile in place.

In another aspect, the invention relates to a method of installing a plurality of sheet piles to form an assembly. The method includes installing a first sheet pile at least partially into the ground using a mandrel, the first sheet pile having a first locking profile. The method further includes installing a second sheet pile at least partially into the ground using the mandrel, the second sheet pile having a second locking profile. The method further includes engaging the second locking profile with the first locking profile while maintaining at least a portion of the first and second locking profiles within a channel of the mandrel.

In yet another aspect, the invention relates to a sheet pile having a first side and a second side, the first side having a first locking profile and the second side having a second locking profile, and further including a gripping flange extending from the second locking profile.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

BRIEF DESCRIPTION OF THE DRAWINGS

FIGS. 1-3 show an example embodiment of an active gripping sheet piling installation system according to the present invention.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figures 2A, 2B:
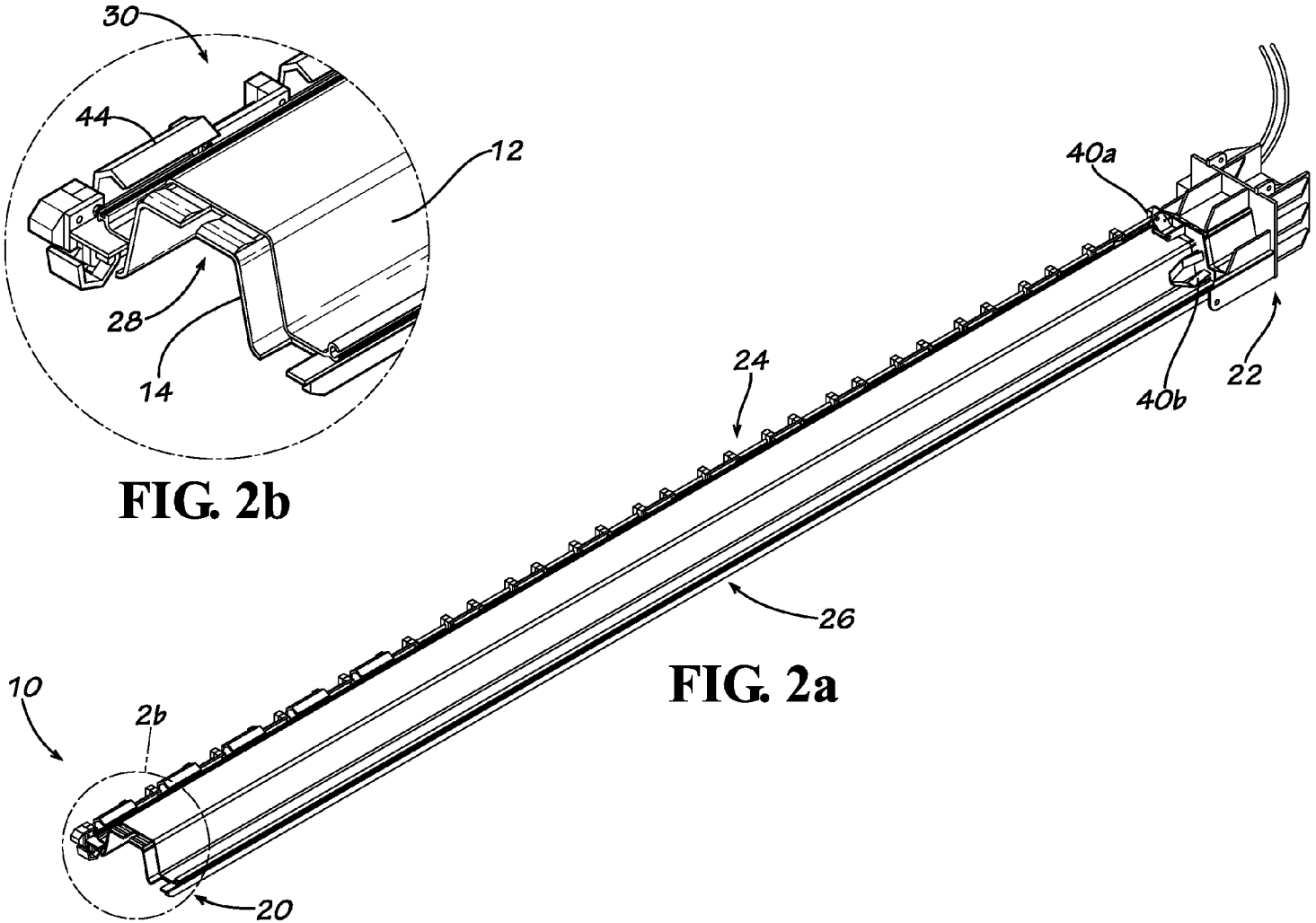
Figure 3B:
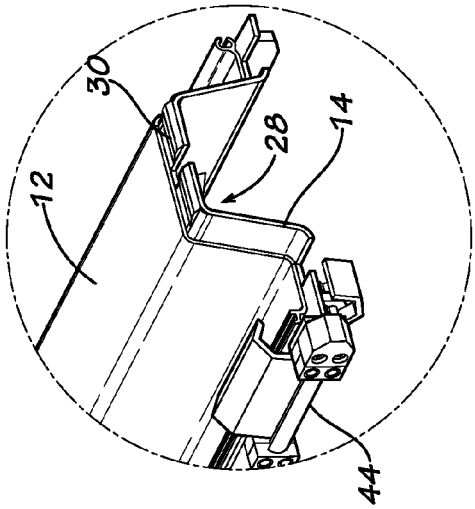
Figure 3A:
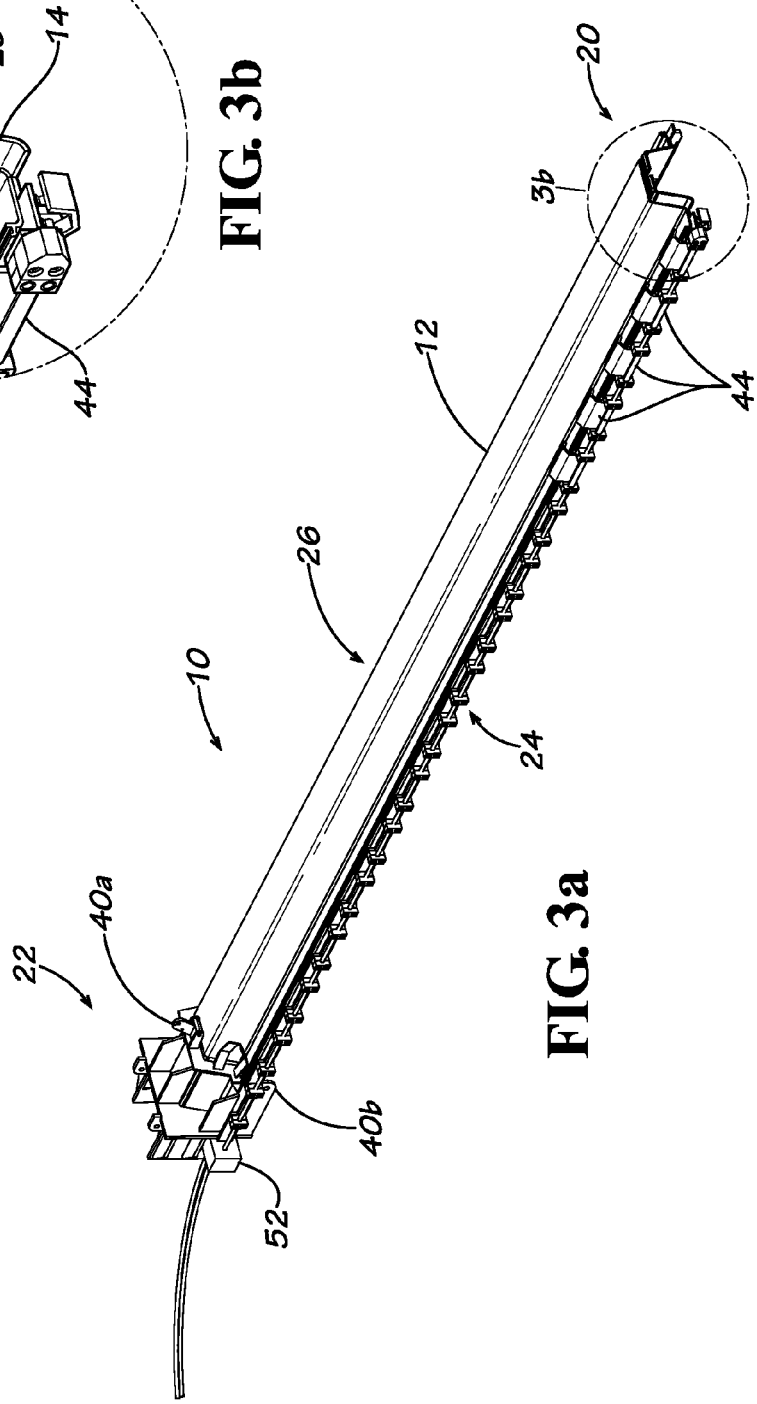

With reference now to the drawing figures, wherein like reference numbers represent corresponding parts throughout the several views, FIGS. 1-3 show an example embodiment of an active gripping system 10 for installation of sheet piles 12. The system 10 comprises a mandrel 14 having a profile generally matching a corresponding portion of the profile of the sheet pile 12. In the depicted embodiment, an external or convex profile portion of the mandrel 14 is cooperatively engagable within an internal or concave profile portion of the sheet pile 12. In alternate forms, an internal or concave profile portion of the mandrel 14 is cooperatively engagable with an external or convex profile portion of the sheet pile 12.

The mandrel 14 comprises an elongate beam of steel, iron or other structural material having sufficient rigidity to be driven into the soil or other substrate to the desired depth of installation of the sheet piles. The mandrel has a lower or leading end 20 that is driven into the substrate, and an opposite upper end 22 that generates or receives the driving or motive force, for example applied vibrationally, hydraulically or by impact. The edge of the leading end 20 of the mandrel is optionally sharp or rounded for improved penetration. The mandrel 14 has first and second lateral sides 24, 26, and inner and outer faces 28, 30 extending between the leading end 20 and the upper end 22.

The mandrel 14 comprises one or more retention members for gripping the sheet pile 12 and holding the sheet pile in place as the mandrel and attached sheet pile are driven into the substrate. For example one or more upper retention members 40 (two are depicted, 40*a*, 40*b*) hold the top end of the sheet pile 12 at or adjacent the upper end 22 of the mandrel, one or more lower retention members 42 hold the bottom end of the sheet pile at or adjacent the leading end 20 of the mandrel, and one or more side retention members 44 hold side edges of the sheet pile along first and second lateral sides 24, 26 of the mandrel.

At least one of the retention members comprises an active gripping retention member. For example, in the depicted embodiment the side retention members 44 comprise active gripping retention members that are engaged and disengaged by application of external force via a shaft 50 actuated by a hydraulic motor and gearbox 52, or by other external actuation means such as for example pneumatic drive means, solenoids or other electromagnetic drive means, and/or motors or other electrical drive means. By contrast, the upper retention members 40 and the lower retention members 42 comprise passive retention members such as hinged clips actuated by contact with the substrate, clamps, resilient arms or lips, or other retention features not engaged or disengaged by application of external force.

Advantageously, application of one or more retention members, whether active or passive, along one or both lateral sides 24, 26 of the mandrel allows application of a gripping force that may be increased with increasing length of the sheet pile (since a longer sheet pile has longer lateral sides, and thus more contact surface for engagement by the retention members). Forces such as skin friction on the surface of the sheet pile as it is driven through the substrate that tend to separate a sheet pile from the mandrel typically increase with increasing drive depths. Accordingly, side retention members may enable deeper drive depths than previously considered feasible, as the gripping force holding the sheet pile to the mandrel can likewise be increased in proportion to the drive depth.

In use, the system 10 enables an installation method for sequential placement of sheet piles in a connected array to form a barrier wall or other structure extending a depth into the soil or other substrate. A sheet pile 12 is mounted with the corresponding profiles aligned along the length of the mandrel 14. The retention members are engaged to secure the sheet pile 12 in place on the mandrel 14. Active gripping retention members such as the side retention members 44 are engaged by actuation of the hydraulic motor which drives the shaft 50 through gearbox 52 to close the side retention members onto the side profile of the sheet pile 12. The active gripping force of the side retention members onto the sheet pile 12 against the mandrel 14 can be controlled by appropriate selection and operation of the hydraulic motor or other actuation mechanism. The mandrel is then raised into a vertical orientation over the installation site, using a crane and/or other equipment, and the mandrel and affixed sheet pile are driven into the substrate to the desired depth. The active gripping retention members are released by reverse actuation of the hydraulic motor or other actuation mechanism. The mandrel is then withdrawn leaving the sheet pile in place. Passive retention members, if present, typically release in response to the movement of the mandrel upon withdrawal. Sequential sheet piles are then installed in similar fashion, with the male and female engagement profiles of adjacent sheet pile members interengaged, to form the barrier wall or other structure.

Figure 8:
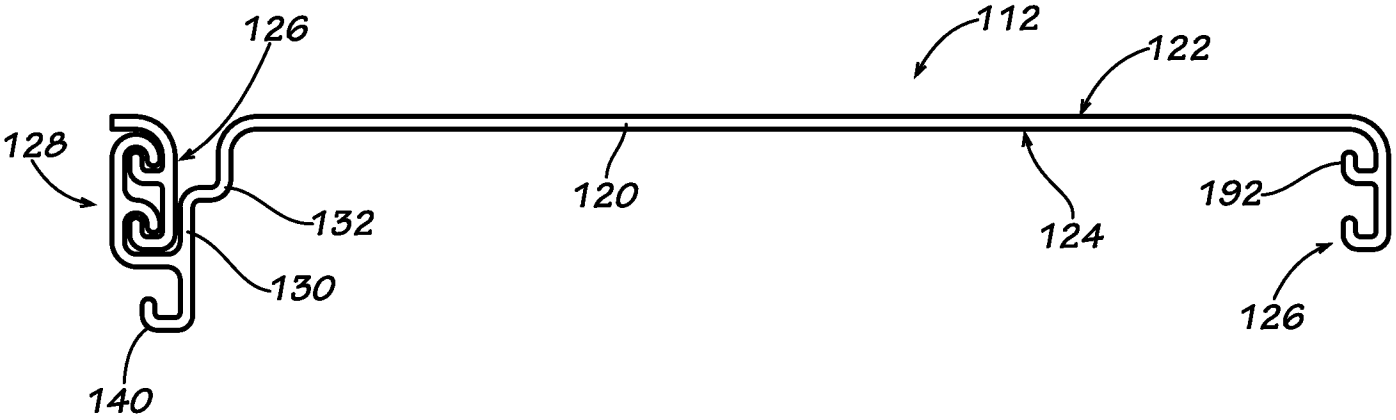
FIG. 8 shows a flat panel sheet piling profile suited for use in connection with the active gripping sheet piling installation system of FIGS. 4-7.

FIGS. 4-7 show another example embodiment of an active gripping system 110 for installation of sheet piles 112 using a mandrel 114, in similar fashion to that described above. FIG. 8 shows an example form of a sheet pile 112 suited for use in connection with system 110. In this embodiment, active gripping retention members engage both lateral sides of the sheet pile 112 during installation, providing additional support and retention, and thereby potentially enabling deeper installations and/or installations into more difficult substrates.

With reference to FIG. 8, the sheet pile 112 has a substantially planar profile across the width of its main body panel 120, defining generally flat front and rear faces 122, 124. A first locking profile 126 extends from one side (the right-hand side in FIG. 8) of the main body panel 120, and a second locking profile 128 extends from the opposite side. Each of the first and second locking profiles 126, 128 extend from the main body panel 120 at approximately a 90° angle, in the direction of the rear face 124. Each of the first and second locking profiles 126, 128 include a pair of engagement flanges each having a J-shaped cross-sectional profile and forming interengaging channels. In alternate embodiments, a single engagement flange or three or more engagement flanges may be provided. The provision of multiple engagement flanges provides a more secure attachment between adjacent sheet piles and additional resistance to fluid migration across a barrier wall formed of such sheet piles. Additionally, if a sealant or grout is applied along the locking profiles during installation, multiple engagement flanges provide multiple seal points. The engagement flanges of the first locking profile 126 project inwardly toward the main body panel 120 and forward (in the direction of the front face 122). The engagement flanges of the second locking profile 128 project inwardly toward the main body panel 120 and rearward (in the direction of the rear face 124). In this manner, first and second locking profiles 126, 128 of adjacent sheet piles are interengagable to form a connected array of sheet piles, as shown at the left-hand side of FIG. 8, and in FIGS. 4*a* and 4*c*.

Figure 4A:
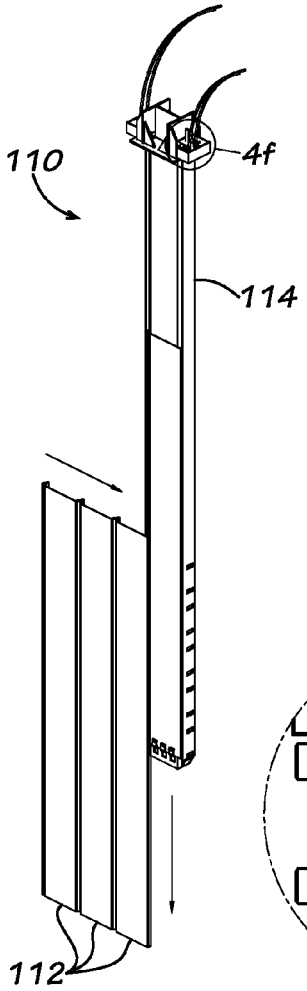
FIGS. 4-7 show another example embodiment of an active gripping sheet piling installation system according to the present invention.
Figure 4C:
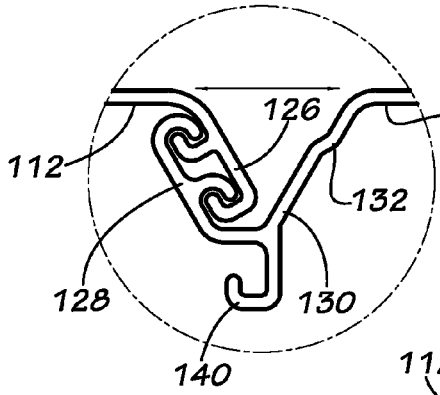

The second locking profile 128 of the sheet pile 112 extends transversely and forward from a connecting panel 130, which in turn extends rearward from the main body panel 120, as seen best with reference to FIGS. 4*c* and 8. A generally rectangular offset 132 is optionally provided at the transition between the main body panel 120 and the connecting panel 130. The material of the sheet pile 112 is preferably sufficiently flexible to permit expansion at the seams connecting adjacent sheet piles in a connected array by flexure of the sheet piles without detachment or "unzipping" of the interengaging first and second locking profiles 126, 128. For example, as seen with reference to FIG. 4*c*, the offset 132 may expand, and the first locking profile 126 and the connecting panel 130 may bend toward the plane of the main body panel 120 to permit accordion-like expansion of the interconnected piles while maintaining the integrity of the connection and fluid barrier therebetween.

A gripping flange 140 extends rearward from the distal edge of the connecting panel 130, defining a J-shaped channel having an opening directed forward and away from the main body panel 120. The provision of a gripping flange separate from the first and second locking profiles 126, 128 allows engagement with the mandrel 114 along both lateral sides of the sheet pile 112 from the direction of its rearward face, without interfering with the engagement of the locking profiles during installation.

Figure 4D:
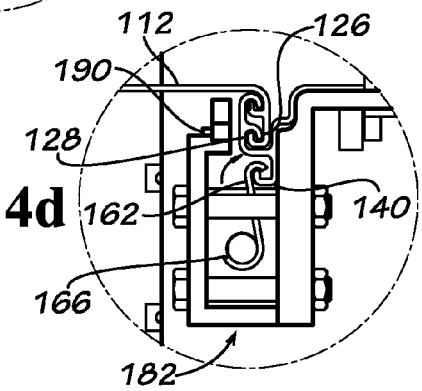
Figure 4E:
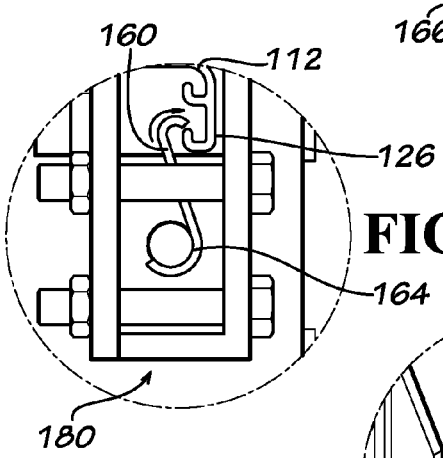
Figure 4F:
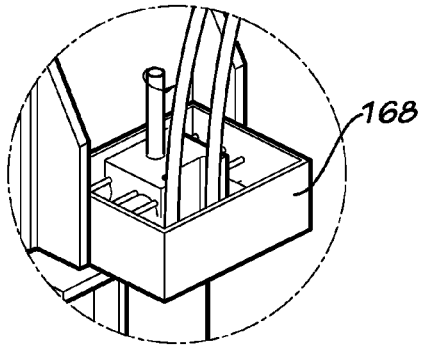
Figure 4B:
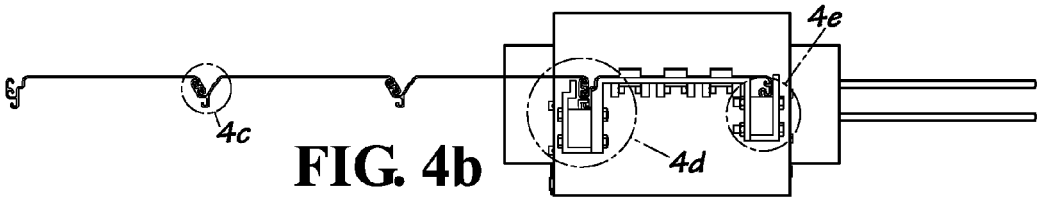
Figure 5B:
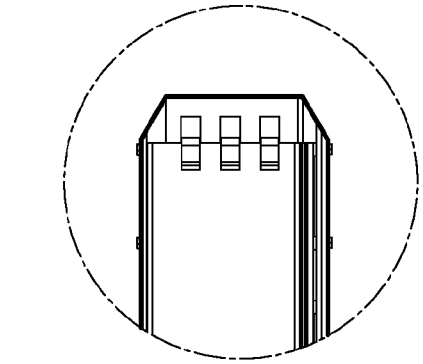
Figure 5D:
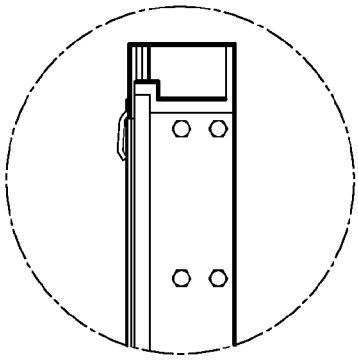
Figure 5A:
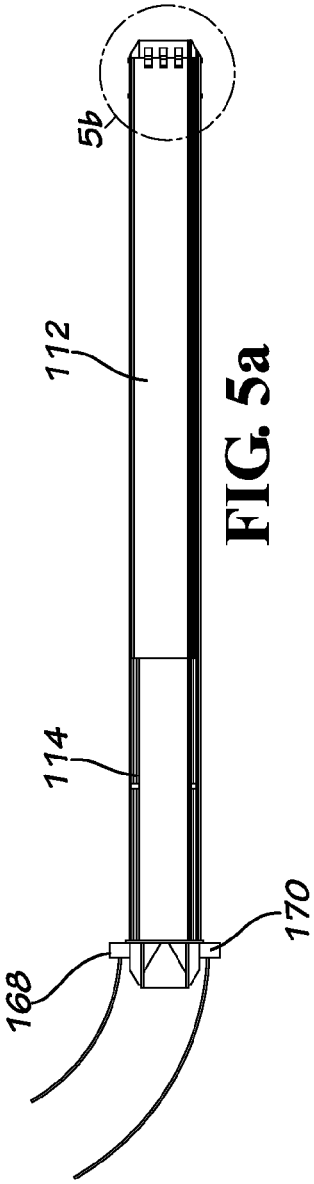
Figure 5C:
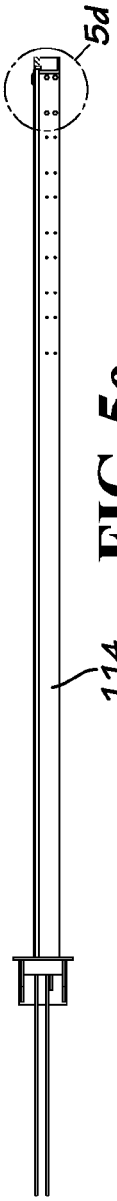
Figure 5E:
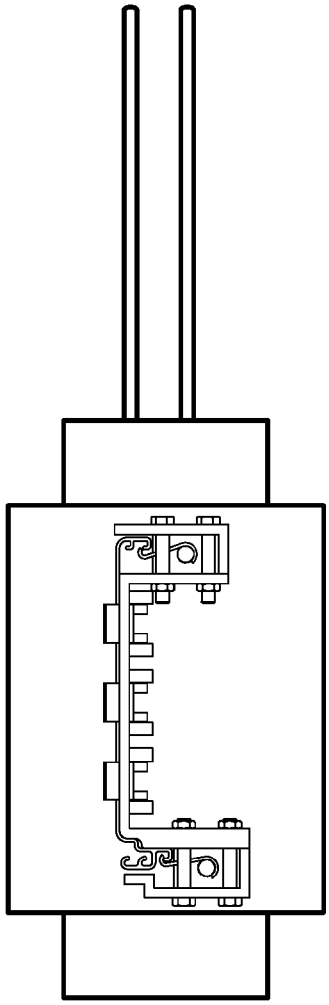
Figures 6A, 6B:
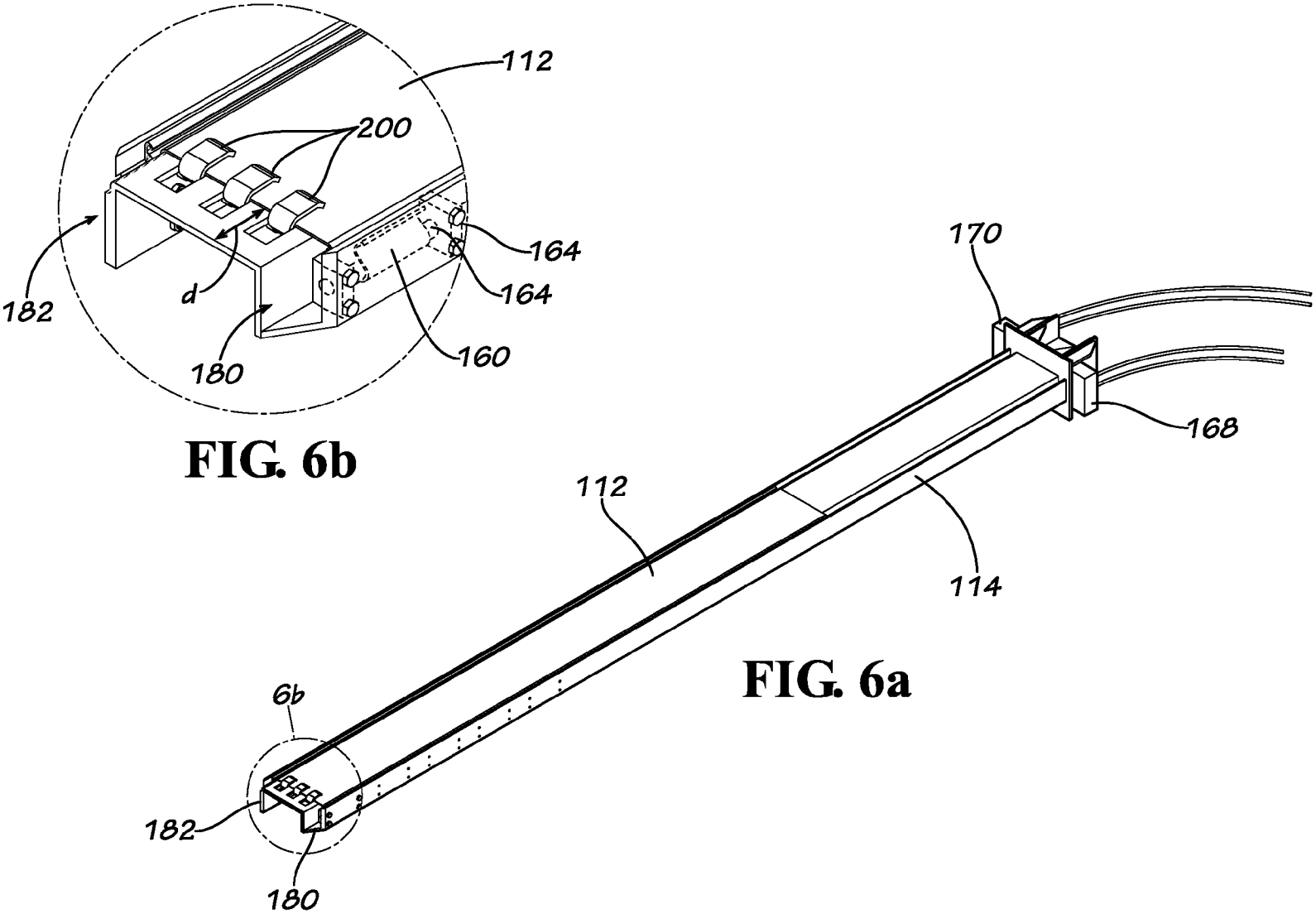
Figure 7B:
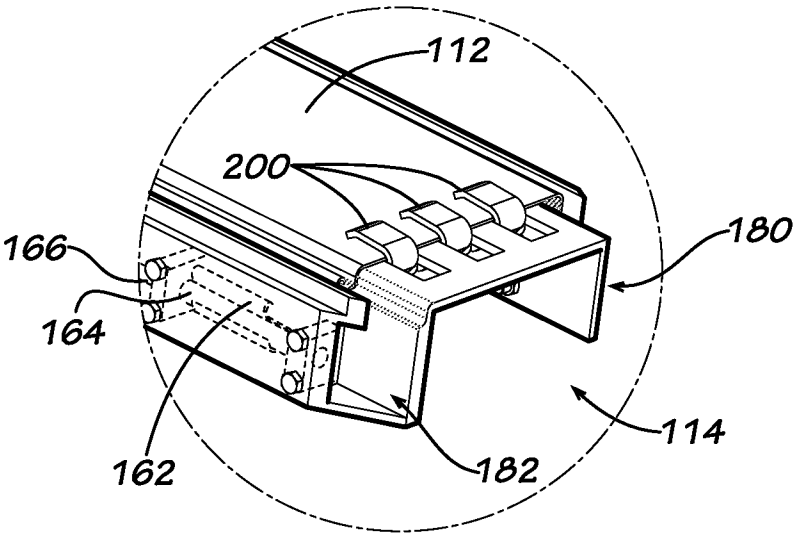
Figure 7A:
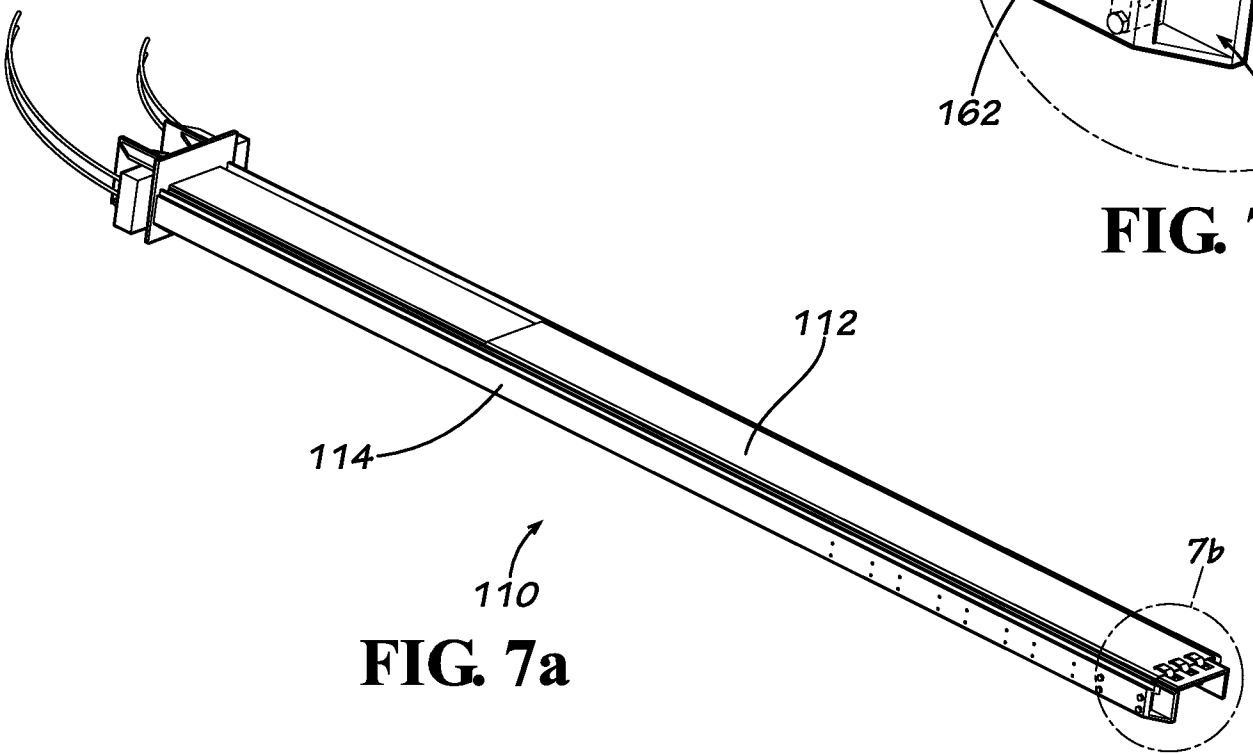

As seen best with reference to FIGS. 4*d* and 4*e*, one or more first active gripping retention members 160 of the mandrel 114 engage the first locking profiles 126 along one side of the sheet pile 112, and one or more second active gripping members 162 engage the gripping flange 140 along the other side of the sheet pile. The active gripping retention members 160, 162 comprise a hooked profile adapted to releasably engage the sheet pile upon rotational actuation by hydraulic motors or other actuation means via shafts 164, 166 extending along opposite sides of the mandrel, coupled to the motors through gearboxes 168, 170 at the upper end of the mandrel. In alternate embodiments, the active gripping retention members comprise cams, wedges or other engagement elements driven by any external actuation means including without limitation hydraulic or pneumatic actuators, electric or electromagnetic actuators, or other actuation means.

The mandrel 114 comprises first and second channels 180, 182 extending along its length on opposite sides thereof for housing the active gripping retention members and shafts, and for shielding the first and second locking profiles 126, 128 from damage by the substrate during installation of the sheet piles. As seen with reference to FIG. 4*d*, the second channel 182 also encloses the interengaging first and second locking profiles 126, 128 of adjacent sheet piles along each side during installation, thereby improving alignment and better ensuring engagement of the locking profiles. Optionally, a lock insertion verification sensor 190, such as a magnetic or RFID sensor, is provided on the second channel toward the lower end of the mandrel 114, for sensing a cooperating indicator or tag 192 on or in the first locking profile to verify the first and second locking profiles of adjacent sheet piles are engaged after installation at their installed depth.

One or more passive engagement members 200 are pivotally mounted toward the lower end of the mandrel 114, actuated by contact with the substrate as the mandrel is driven into the ground, to engage the sheet pile 112 against the mandrel and to protect the leading edge of the sheet pile from damage by the substrate during installation. The pivot axis of the passive engagement members 200 is spaced a distance d from the lower or leading edge of the mandrel 114, so that the leading edge of the mandrel bears the brunt of the impact with the substrate upon installation, rather than the leading edge of the sheet pile 112.

In use, the system 110 enables an improved method of installation of sheet piles to form a barrier wall or other structure. A sheet pile 112 is mounted onto the mandrel 114, and engaged by actuation of active gripping members 160, 162 along the length of both sides of the sheet pile. The mandrel is raised vertically into place above the installation site, and is driven into the ground to the desired depth, carrying the sheet pile into place. The active gripping members are then actuated to release the sheet pile, and the mandrel is withdrawn leaving the sheet pile in place. Subsequent sheet piles are sequentially driven into place in like manner, with the second locking profiles 128 of the sheet pile being driven into place on the mandrel being slid into engagement onto the first locking profiles 126 of the adjacent, previously placed sheet pile.

On each subsequent drive of the mandrel, the second channel 182 follows an existing path through the substrate that was cut by the first channel 180 on the previous drive of the mandrel. Thus, the second locking profiles of the sheet pile being installed (which are enclosed in the second channel 182 of the mandrel) are better maintained in alignment with the first locking profiles of the previously installed sheet pile (which were enclosed in the first channel 180 of the mandrel on the previous drive). Also, because the rigid second channel 182 of the mandrel surrounds the second locking profiles of the sheet pile being installed and the first locking profiles of the previously installed sheet on both sides (see FIG. 4*d*), the alignment of the sheet piles and the interengaging connection between the first and second locking profiles is better maintained during installation. Rather than relying on the interlock strength of the locking profiles of the plastic sheet piles to maintain engagement during installation, the much more rigid and stronger steel or iron material of the mandrel maintains the engagement.

And even in the event of some degree of misalignment of the sheet piles during installation, the accordion-like expansion provided by the above-described sheet pile profile (see FIG. 4*c*) compensates for the misalignment and maintains engagement of the locking profiles. In the event of a misalignment so substantial as to exceed the expansion limit of the immediately adjacent sheet pile connection, the greater engagement force provided by the double engagement flanges of the locking profiles and the relatively flat main body portion 120 of the sheet pile profile allow expansion across multiple sheet piles to compensate for the misalignment and maintain engagement of the locking profiles.

Figure 9:
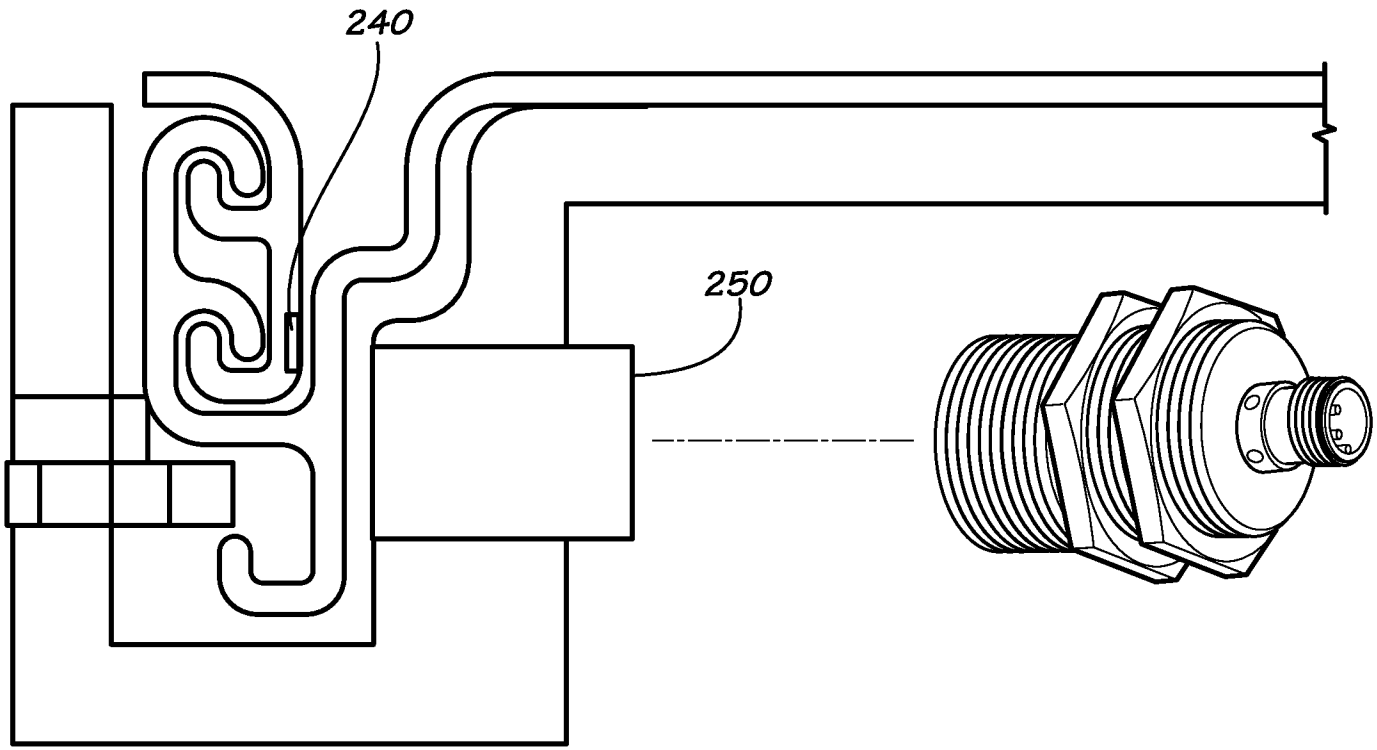
FIG. 9 shows a sensor and tag for verifying engagement of sheet piles.

FIG. 9 shows a system for remotely verifying engagement of sheet piles within a barrier wall or other array. A sacrificial tag 240 such as an RFID tag is embedded in or otherwise affixed to a portion of a locking profile of a sheet pile, and an RFID sensor 250 is provided on the mandrel. The RFID sensor is connected by wire, wireless transmitter, or otherwise communicates with a remote monitor. Optionally, multiple tags are secured to the sheet pile at spaced locations along the length of the locking profile to confirm engagement at successive depths during installation, for example at 5'-10' increments. Optionally, each tag or each sheet pile may be given a unique tag ID indicator for identification and record maintenance to confirm verification of the integrity of a barrier installation.

By actively gripping the sheet pile along both sides, the system of the present invention does not rely on the rigidity of the sheet pile to resist buckling of the sheet pile or peeling of the sheet pile away from the mandrel during installation. Accordingly, the corrugated cross-sectional profile typical of previously known sheet piles, necessary for the rigidity required by prior installation systems and methods, is not needed in the present system and method. As such, a relatively flat sheet pile profile can be utilized regardless of the depth of placement. Indeed, because the system and method of the present invention can grip the sheet pile from the sides, along all or substantially all of the length of the sheet pile, the gripping force applied by the mandrel on the sheet pile can increase with the length of the longer sheet piles used in deeper installations.

Since the system and method of the present invention do not rely on the rigidity of the sheet pile itself to resist buckling and peeling away from the mandrel during installation, a thinner material thickness can be utilized for the sheet piles. This, combined with the elimination of the need for a corrugated sheet pile profile, can considerably reduce the quantity of material used to form the sheet piles, thereby reducing manufacturing costs and conserving resources. Wider sheet piles can also be used with the system and method of the present invention than was possible with previously known systems and methods, thereby reducing the number of drives required for a structure of given length, and consequently reducing installation time and expense. Wider sheet piles also result in fewer seams, thereby reducing the potential for fluid migration through the seams of a barrier.

While the invention has been described with reference to preferred and example embodiments, it will be understood by those skilled in the art that a variety of modifications, additions and deletions are within the scope of the invention, as defined by the following claims.

What is claimed is:

1. A sheet pile for installation using a mandrel, the sheet pile comprising: an elongate main body panel, a first side portion extending from a first side of the main body panel, a second side portion extending from a second side of the main body panel opposite the first side, a first locking profile extending from the first side portion along a lengthwise dimension of the sheet pile, and a second locking profile extending from the second side portion along the lengthwise dimension of the sheet pile, the first and second locking profiles each comprising a pair of engagement flanges, the sheet pile further comprising a gripping flange extending along the lengthwise dimension of the sheet pile in alignment with the second locking profile, wherein the gripping flange is offset in a first direction from the main body panel and offset in a second direction from the second locking profile, wherein the mandrel releasably engages the gripping flange during installation.

2. The sheet pile of claim 1, wherein the main body panel is generally flat between the first and second sides.

3. The sheet pile of claim 1, wherein the generally flat main body panel comprises a front face and a rear face.

4. The sheet pile of claim 3, wherein the first locking profile extends at a generally ninety-degree angle in the direction of the main body panel front face.

5. The sheet pile of claim 4, wherein the first locking profile comprises a pair of engagement flanges.

6. The sheet pile of claim 3, wherein the second locking profile extends at a generally ninety-degree angle in the direction of the main body panel rear face.

7. The sheet pile of claim 3, wherein the first locking profile comprises at least one engagement flange.

8. The sheet pile of claim 7, wherein the at least one engagement flange comprises a J-shaped cross-sectional profile.

9. The sheet pile of claim 7, wherein the at least one engagement flange projects toward the main body panel front face.

10. The sheet pile of claim 3, wherein the second locking profile comprises at least one engagement flange.

11. The sheet pile of claim 10, wherein the second locking profile comprises a pair of engagement flanges.

12. The sheet pile of claim 10, wherein the at least one engagement flange comprises a J-shaped cross-sectional profile.

13. The sheet pile of claim 10, wherein the at least one engagement flange projects toward the main body panel rear face.

14. The sheet pile of claim 1, wherein the first locking profile and the second locking profile, of sheet piles in an array, form interengaged channels.

15. The sheet pile of claim 14, wherein the second locking profile of a first sheet pile in the array extends transversely and forward from the main body panel, and the first locking profile of a second sheet pile in the array extends transversely rearward from the main body portion.

16. The sheet pile of claim 1, wherein the sheet pile comprises at least one generally rectangular offset between the main body panel and at least one of the first locking profile and the second locking profile.

17. The sheet pile of claim 1, wherein the sheet pile is constructed of flexible material.

18. The sheet pile of claim 1, wherein the gripping flange comprises a J-shaped channel.

19. The sheet pile of claim 1, comprising a remotely-verifying mechanism configured to confirm engagement of sheet piles in an array.

20. The sheet pile of claim 19, wherein the remotely-verifying mechanism comprises a sacrificial tag secured with respect to at least one of the group comprising the first locking profile and the second locking profile.

21. The sheet pile of claim 20, wherein the sheet pile comprises a plurality of sacrificial tags secured at spaced locations along a length of the sheet pile.

22. The sheet pile of claim 20, wherein each sacrificial tag on each sheet pile in an array comprises a unique identifier.

23. The sheet pile of claim 20, wherein the remotely-verifying mechanism further comprises a reusable sensor mounted to a mandrel for driving the sheet pile into a substrate, the reusable sensor operable to sense proximity with the sacrificial tag.

24. The sheet pile of claim 23, wherein the remotely-verifying mechanism comprises an RFID (radio frequency identification) tag and sensor system.

25. A sheet pile in combination with a mandrel for installation of the sheet pile, the mandrel comprising a reusable sensor and a gripping member, the sheet pile comprising: a first side and a second side, the first side having a first locking profile and the second side having a second locking profile, the sheet pile further comprising a gripping flange for releasable engagement with the gripping member of the mandrel during installation, and a sacrificial tag for verifying interengagement of first and second locking profiles of adjacent sheet piles in an array, wherein the sacrificial tag is in communication with the mandrel sensor upon installation and the mandrel sensor is removed from communication with the sacrificial tag when the mandrel is withdrawn from engagement with the sheet pile after installation.

26. The sheet pile of claim 25, in combination with the mandrel sensor, the mandrel sensor operable to sense proximity with the sacrificial tag to verify interengagement of the first and second locking profiles of adjacent sheet piles in the array.

27. The sheet pile of claim 25, wherein the sacrificial tag comprises an RFID (radio frequency identification) tag.

28. The sheet pile of claim 25, comprising a plurality of sacrificial tags spaced along a length of the sheet pile.

29. A sheet pile in combination with a mandrel for installation of the sheet pile, the sheet pile comprising:

a main body panel, a first side portion extending from a first side of the main body panel, and a second side portion extending from a second side of the main body panel opposite the first side, a first locking profile extending from the first side portion, and a second locking profile extending from the second side portion;

at least one gripping flange extending along a lengthwise dimension of the sheet pile in alignment with the second locking profile and offset from the main body panel, the first side portion and the second side portion, wherein the at least one gripping flange releasably is engaged with the mandrel during installation; and a remotely-verifying mechanism configured to confirm engagement of sheet piles in an array, the remotely-verifying mechanism comprising a reusable sensor affixed to the mandrel and a sacrificial tag affixed to the sheet pile, the reusable sensor being in operative communication with the sacrificial tag upon installation of a sheet pile using the mandrel and withdrawn from operative communication with the sacrificial tag upon removal of the mandrel from the sheet pile.

30. The sheet pile of claim 29, wherein the at least one gripping flange extends from at least one of the group comprising the first locking profile and the second locking profile.

31. The sheet pile of claim 29, wherein the sacrificial tag is secured to at least one of the group comprising the first locking profile and the second locking profile.

32. The sheet pile of claim 31, wherein the sacrificial tag comprises an RFID (radio frequency identification) tag.

33. The sheet pile of claim 29, wherein the sacrificial tag is secured to at least one of the group comprising the first side and the second side.

34. The sheet pile of claim 29, wherein the remotely-verifying mechanism comprises a plurality of sacrificial tags spaced along a length of the sheet pile.

* * * * *